United States Patent [19]

Bajulaz

[11] 4,021,158

[45] May 3, 1977

[54] SPHERICAL PISTON MACHINE

[76] Inventor: Roger Bajulaz, 22, Chemin William-Barbey, 1292 Chambesy, Switzerland

[22] Filed: Sept. 2, 1975

[21] Appl. No.: 609,817

[30] Foreign Application Priority Data

July 3, 1975 Switzerland ..... 8650/75

[52] U.S. Cl. ..... 418/52; 418/164; 418/182; 123/8.47; 418/68

[51] Int. Cl.[2] ..... F01C 1/02; F03C 3/00; F04C 1/02; F02B 55/14

[58] Field of Search ..... 418/49–53, 418/68, 161, 164, 195, 182; 123/8.47, 43 R; 73/253, 255, 261

[56] References Cited

UNITED STATES PATENTS

| | | | |
|---|---|---|---|
| 1,186,610 | 6/1916 | Richards | 418/164 |
| 2,060,209 | 11/1936 | Heckert | 418/182 |
| 2,197,959 | 4/1940 | Wentworth | 418/49 |
| 2,982,222 | 5/1961 | Ball | 418/53 |
| 3,556,696 | 1/1971 | Bertoni | 418/68 |

FOREIGN PATENTS OR APPLICATIONS

| | | | |
|---|---|---|---|
| 1,283,146 | 12/1961 | France | 418/49 |

*Primary Examiner*—John J. Vrablik
*Attorney, Agent, or Firm*—Young & Thompson

[57] ABSTRACT

A spherical piston machine comprises a chamber whose wall is at least partly spherical. A spherical piston, mounted within this chamber, comprises two elements, the chamber and piston delimiting a free space of variable shape. At least one of the elements of the piston is angularly fixed to a control axle, forming an angle with the longitudinal axis of the machine and extending in a direction passing through the center of the spherical chamber. The two elements of the spherical piston are articulated in a zone extending perpendicular to each control axle. Means are provided for rotatably driving about its own axis at least one of the control axles, as well as for rotatably driving each control axle about the longitudinal axis of the machine.

45 Claims, 19 Drawing Figures

56
46
44
41
9
L
45
43
1
57
54
55
10
51
50
8
0
10'
60
5.
6.
58
10
59
61
62
4.
3
7
52
53
0
12
12'
48
42
49
11
47
47'
43
1
L

SPHERICAL PISTON MACHINE

The present invention relates to expansible chamber machines which may be utilized among other things as motors, compressors, pumps, etc. and which avoid rectilinear movement of the movable parts.

The object of the present invention is to provide such a machine, whose construction is simple and rugged and in which the problems of wear and sealing are easily overcome.

The present invention has for its object a spherical piston machine characterized by the fact that it comprises a chamber whose wall is at least partially spherical: a spherical piston mounted inside this chamber, comprising two elements; this chamber and this piston defining a free space of variable shape; by the fact that at least one of the piston elements is angularly fixed to a control axle forming an angle with the longitudinal axis of the machine and extending in a direction passing through the center of the spherical chamber; by the fact that the two elements of the spherical piston are articulated in a zone extending perpendicular to each control axle; by the fact that it comprises means for drivingly rotating at least one of the control axles; and by the fact that it comprises means for drivingly rotating each control axle about the longitudinal axis of the machine.

The accompanying drawing illustrates schematically and by way of example, different embodiments of the machine according to the invention.

Figure 1:
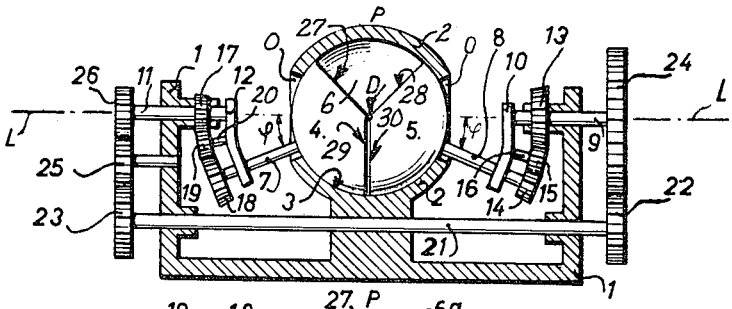
FIGS. 1–5 are kinematic diagrams illustrating a first embodiment, in five successive positions representing a complete cycle of the spherical piston.

The illustrated device is a spherical piston expansible chamber device which, as shown on the schematic FIGS. 1 to 5, comprises a construction 1 comprising a casing 2 defining a chamber 3 whose wall is part-spherical. This machine comprises a spherical piston, that is, whose periphery is spherical, of a diameter corresponding to that of the chamber, so as to move without play in the interior of the latter.

This spherical piston is in two parts or elements 4, 5. Each element has the general form of a quarter sphere. This piston 4, 5 and the chamber 3 define a total free space 6 whose shape varies as a function of the movement of the piston but whose total volume remains constant.

In certain modifications each element of the piston may be constituted by a plurality of mechanical parts, such as hinge and joints.

The elements of piston 4, 5 are displaceable relative to each other by pivoting about a zone articulation D, which is approximately straight and coincides with the edge of each quarter sphere 4, 5 and with a diameter of the chamber 3. Each element 4, 5 is fixed at least angularly to a control axle 7, 8 respectively, which protrudes from the chamber through circular openings 0 centered in the longitudinal axis L of the machine.

The machine also comprises means for drivingly rotating the control axle of each element 4, 5 about the axis L of the machine.

The means for rotatably driving the control axle 8 about the axis L, comprises a main shaft 9, pivoting in construction 1 coaxially of the axis L of the machine, carrying a support 10 in which is rotatable the control axle 8. This control axle 8 forms an angle $\psi$ with the axis L of the machine.

The means for rotatably driving the control axle 7 about the longitudinal axis L of the machine comprises, similarly, a secondary shaft 11 rotatable in construction 1 concentrically with the axis L but on the other side of piston 4, 5. This secondary shaft carries a support 12 in which the control axle 7 is rotatable.

The machine also comprises means for rotating about itself the control axle 8, comprising: a toothed pinion 13, fixed to structure 1; a toothed pinion 14, fixed to control axle 8; and an intermediate pinion 15 meshing with the two pinions 13 and 14 and rotatable on an axle 16 fixed to support 10. Pinion 13 is coaxial with axis L of the machine and intermediate pinion 15 is rotatable about an axis passing through the center of the spherical chamber 3. The gear ratio between main shaft 9 and control axle 8 is equal to two and these axles turn in opposite directions from each other.

The means for rotatably driving the control axle 7 about its own axis comprises a pinion 17 fixed to construction 1 and coaxial with axis L of the machine; a pinion 18 fixed to the control axle 7; and an intermediate pinion 19, rotatable on an axle 20 fixed to support 12 and extending in a direction passing through the center of the spherical chamber 3. The gear ratio between secondary shaft 11 and control axle 7 is ⅔, this shaft and this axle turning in opposite directions from each other.

Finally the machine comprises also means for connecting main shaft 9 and secondary shaft 11 comprising a connecting shaft 21, rotatable on construction 1 parallel to the axis L of the machine, carrying at each of its ends a pinion 22, 23. Pinion 22 is in mesh with a toothed wheel 24, fixed to the main shaft 9, while pinion 23 engages with an intermediate pinion 25, rotatable on construction 1, and itself in mesh with a toothed wheel 26 fixed to the secondary shaft 11. The gear ratio between main shaft 9 and secondary shaft 11 is three, the secondary shaft turning in the opposite direction and more rapidly than the main shaft. In the position illustrated in FIG. 1, the zone or line D of articulation of the two piston elements 4, 5 is horizontal and the free space 6 is unitary, defined by the faces 27, 28 of elements 4, 5 and the wall of the chamber 3. The other faces 29, 30 of elements 4, 5, respectively, are against each other.

Figure 2:
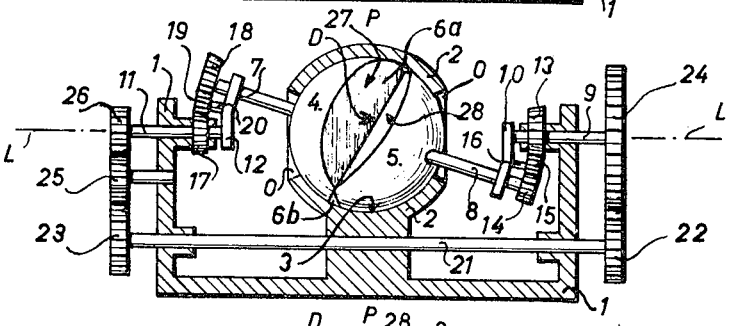

To move from the position shown in FIG. 1 to that illustrated in FIG. 2, the main shaft 9 is turned through 45°. By virtue of the various drive ratios described above, this rotation effects: a 45° rotation of the control axle 8, about the axis L of the machine, in the same direction as the main shaft 9; a 90° rotation, in the opposite direction, of the control axle 8 about its own axis; a 135° rotation, in the opposite direction, of the secondary shaft 11; and a 90° rotation about its own axis of the control axle 7 relative to the secondary shaft 11 and in the opposite direction.

These various movements of the control axles 7, 8 result in a displacement of the piston 4, 5 within the chamber 3, such that the line D is located in a plane that forms an angle of 45° relative to the horizontal plane that contains this line D, in the position illustrated in FIG. 1. Therefore, this line D is inclined relative to a vertical plane P passing through the center of the chamber 3, at an angle equal to angle $\psi$ between the control axle and the axis L of the machine.

The two elements 4, 5 have therefore pivoted relative to each other about the zone or line D, while not being directly mechanically connected to each other. In this position the free volume 6 is divided in two parts 6*a* and 6*b* equal to each other but the total volume is not changed.

Figure 3:
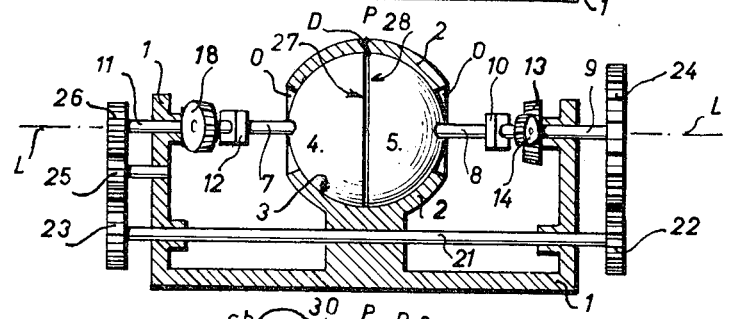

FIG. 3 illustrates the positions occupied by the different parts of the machine if the main shaft is turned through 90° relative to its initial position (FIG. 1) or through an additional 45° in the same direction relative to FIG. 2. The faces 27, 28 of the elements 4, 5 are together, the line D is vertical and the free volume 6 is not visible because it opens rearwardly and is defined between the faces 29 and 30 of the piston and the wall of chamber 3.

Figure 4:
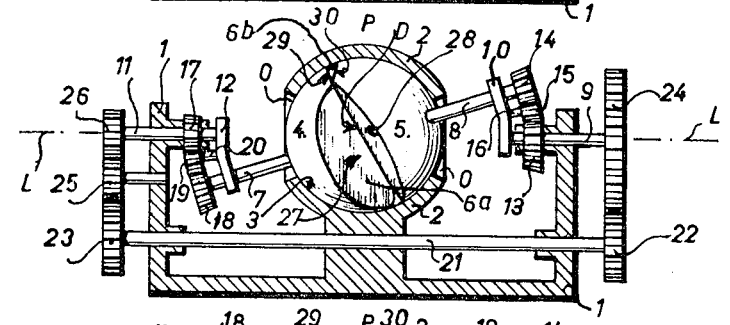

If the main shaft 9 undergoes a further rotation of 45° in the same direction, the machine assumes the position shown in FIG. 4. The line D is again inclined at 45° relative to a horizontal plane and the angle $\psi$ relative to the plane of symmetry of the machine but this time inclined in the opposite direction.

Figure 5:
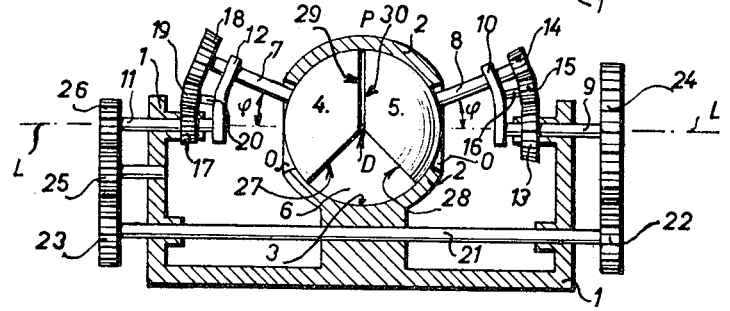

If the main shaft 9 turns a further 45°, again in the same direction, the machine assumes the position shown in FIG. 5. The line D is again horizontal, the free volume 6 defined between the face 27, 28 and the wall 3, but the spherical piston has rotated through 180° relative to the position illustrated in FIG. 1. The piston has thus effectuated a complete cycle — one rotation on itself of 180°.

It should also be noted that the control axles 7, 8 describe cones whose apex coincides with the center of the sperical chamber and whose apex angle is equal to 2 $\psi$. Finally, in the medial positions of the piston cycle (FIGS. 2 and 4) the control axles 7, 8 are in alignment, while for all other positions they form an angle between themselves, this angle being equal to 180°–2 $\psi$ in the other illustrated positions (FIGS. 1, 3 and 5).

In the embodiment shown in FIGS. 1–5, it will therefore be seen that for a complete cycle of the piston the line D turns through an angle $\alpha'$ equal to 180° about the longitudinal axis L of the machine; the main shaft 9 rotates through an angle $\beta'$, which in this case is equal to the angle $\alpha'$; while the secondary shaft 11 rotates through an angle $\gamma'$ equal to $(360° + \beta')$; being of negative sign, the shafts turning in opposite directions from each other. $\gamma'$ is thus the complement to 360° of $\beta'$.

The embodiment illustrated in FIGS. 1–5 corresponds to a machine in which the piston rotates through 180° for a complete cycle, that is to say, 90° for the passage from a position in which the two faces of the piston are together to a position in which the same faces are spaced farthest apart (the other faces then being together).

The machine may thus be characterized by the angle $\alpha$ corresponding to the angle of rotation of the piston about the axis L of the machine during one-half cycle of the piston, so that if:

$\alpha = 90°$ it follows that the angle:

$\beta = -90°$ $\gamma = 270°$ and the number of cycles of the piston for a complete revolution of the same is $n = 2$.

In the described embodiment, it will be seen that the ends of the line D follow, in the course of the two cycles of the piston, a sinusoidal trace about a great circle of the chamber 3 located in a vertical plane P.

It will on this basis be possible to conceive other types of machines in which the angle $\alpha$ of rotation of the line D, or of the piston, about the axis L of the machine, permitting the movement from a closed position to an open position of the same faces of the piston, will be different.

If the ratios are established:

$$a = \frac{\text{number of turns of main shaft 9}}{\text{number of turns of secondary shaft 11}}$$

$$b = \frac{\text{number of turns of main shaft 9}}{\text{number of turns of control axle 8}}$$

$$c = \frac{\text{number of turns of secondary shaft 11}}{\text{number of turns of control axle 7}}$$

the following table can be drawn for different cases, $n$ being the number of cycles of the piston for a complete revolution of the piston about the axis L of the machine.

| | | | | |
|---|---|---|---|---|
| $\alpha$ | 90° | 60° | 45° | 0° |
| $\beta$ | −90° | −120° | −135° | −180° |
| $\gamma$ | 270° | 240° | 225° | 180° |
| $\eta$ | 2 | 3 | 4 | ∞ |
| a | −3 | −2 | −5/3 | −1 |
| b | −2 | −3/2 | −4/3 | −1 |
| c | −2/3 | −3/4 | −4/5 | −1 |

To illustrate these different possibilities, the case $\alpha = 90°$ having been described above, there will now be described the case in which $\alpha = 0°$ with reference to FIGS. 6–9. In these FIGS. the same reference numerals have been used to indicate the corresponding elements of FIGS. 1–5.

Thus in this second embodiment, the ratios $a$, $b$ and $c$ are all equal to one. The secondary shaft 11 turning in the opposite direction from the main shaft 9, the control axle 8 turning about its own axis in the opposite direction from the main shaft 9, and the control axle 7 rotating about its own axis in the opposite direction from secondary shaft 11.

Figure 6:
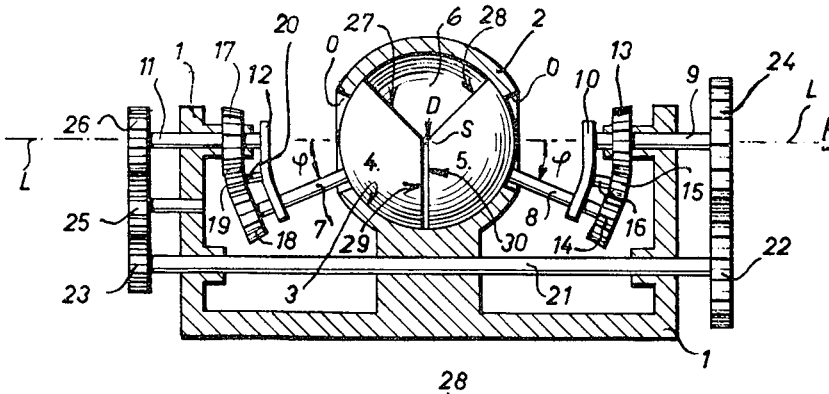
FIGS. 6–9 are diagrams like those illustrated in FIGS. 1–5 but of a second embodiment of the machine.

FIG. 6 shows the machine in the same positions as those illustrated in FIG. 1, that is, the piston 4, 5 being located in one of its end positions, the free space being defined between the faces 27, 28 and the wall 3 of the spherical chamber. In this position, the control axles 7 and 8 are in a vertical plane passing through the longitudinal axis L of the machine.

Figure 7:
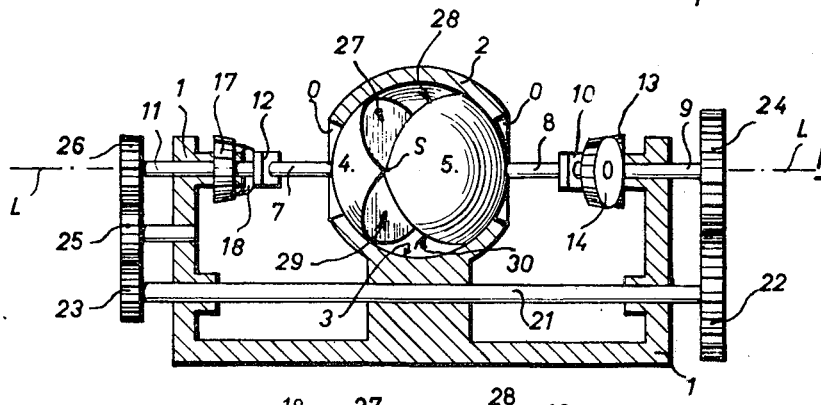

If the main shaft is now rotated clockwise through 90°, the elements of the machine will take the position shown in FIG. 7. Thus the control axles 7, 8 each rotate through 90° in opposite directions from each other, about the axis L of the machine and become aligned and disposed in a horizontal plane; the control axle 7 turning clockwise. At the same time, each of these control axles has rotated 90° about its own axis, counterclockwise with respect to its support 10, 12, so that the two elements 4, 5 of the piston move in the interior of chamber 3, the aarticulation line D remaining in a horizontal plane passing through the axis L of the machine, but the point S on this line is displaced linearly to the left.

Figure 8:
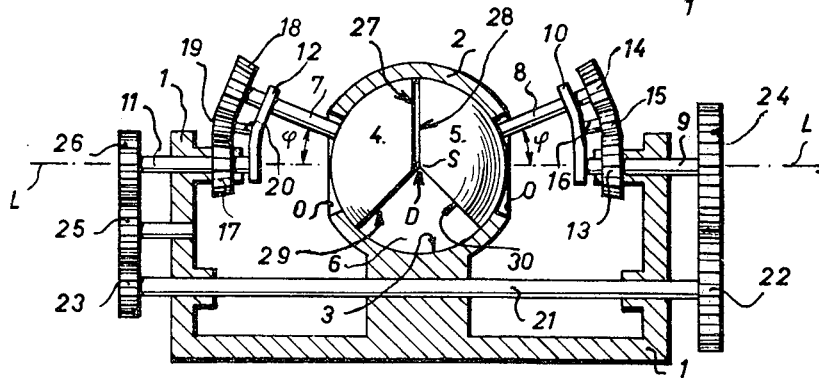

If the main shaft 9 effects a further rotation of 90°, the control axles 7, 8 again turn through 90° about the axis L of the machine, in opposite directions from each other, and through 90° about their own axes in the same direction with respect to their supports, and are disposed in a vertical plane and form an angle with each other. The position shown in FIG. 8 is thus reached. The faces 27, 28 of the piston are together, the articulation line D is again perpendicular to the axis L of the machine and the point S returns linearly in a direction parallel to the axis L of the machine, to the median position that is occupied in FIG. 6. The free space is again unitary, contrary to what it was in the intermediate position of the piston (FIG. 7), but bounded now by the faces 29, 30 of the piston and the wall 3 of the chamber. The piston 4, 5 has thus completed a first cycle.

Figure 9:
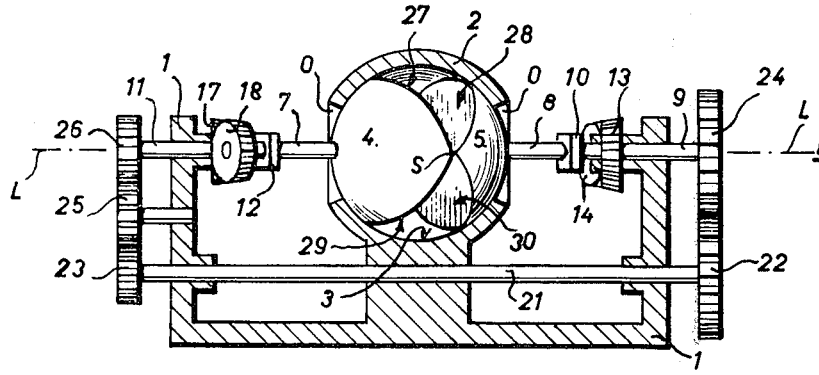

For a subsequent rotation of 90° of the main shaft, namely of 270° from the position of FIG. 6, there is obtained the position of the parts shown in FIG. 9. The control axles have again performed a quarter of a turn in opposite directions about the axis L of the machine as well as about their own axes in the same directions with respect to their supports. These axles 7, 8 are aligned and the elements 4, 5 of the piston are displaced such that the line D is displaced while remaining in a horizontal plane, in a direction opposite to that illustrated in FIG. 7. The point S is displaced in a straight line to the right. Piston 4, 5 is again in the intermediate position in which the free space is divided in two parts of equal volume.

Finally a further rotation of 90° of the main shaft 9 completes the cycle and the machine is again in the position shown in FIG. 6.

If the drive of the main shaft 9 is performed at constant speed, there is obtained a straight line reciprocation of the point S, with sinusoidal variation of the speed of displacement. As will be seen, in this example, there is no rotation of the piston about the axis L of the machine.

It is quite evident that the faces 27, 28, 29 and 30 of the piston need not be flat, but could be concave such that the volume defined by two of these faces and the wall 3 of the chamber does not vary between zero capacity and maximum capacity but between a minimum capacity and a maximum capacity.

In a modification the total volume of the free space may vary during the course of a cycle. Thus the cavities may have an asymmetric shape relative to each other.

In all the embodiments previously illustrated and described, the rigid mechanical connection between the elements 4, 5 of the piston is constituted by two means for driving in rotation about their own axes and about the axis L of the machine, each control axle, as well as by connecting means between the main and secondary shafts.

Under these circumstances, it is not necessary that the two elements 4, 5 of the piston be interconnected in a rigid manner. In fact, excepting the case where $\alpha = 0°$, the speeds of displacement of the elements 4, 5 of the piston are different and asymmetric. The asymmetry of movement means that the articulation line D which was previously considered to be ideal, cannot be realized because there is relative movement of one with respect to the other of the edges of each element 4 and 5, formed by the intersection of the faces 27, 29 and 28, 30, respectively. This imaginary line D is thus properly considered a zone of articulation.

Thus if it is desired to use the present machine in a motor or pump, it is necessary to provide a fluidtight joint between the elements 4 and 5 along the zone of articulation D, which may be subjected to deformations or permit sliding movement, in two orthogonal directions, of one element 4, 5 with respect to the other.

In all cases in which the piston 4, 5 undergoes rotation about the axis L of the machine, there can be provided, to use the machine as a motor or pump, inlet and outlet passageways, spaced about the chamber 3 in an annular zone swept by the free space.

In the case in which $\alpha = 0°$, that is, in which the piston 4, 5 has no rotation about the axis L of the machine, passages can be provided, provided with valves, located in the elements 4, 5 and connecting the faces 27, 29 and 28, 30 of the same piston element.

As will be seen later on, it is also possible, for eliminating the means for drivingly rotating one of the control axles, to interconnect rigidly, for example by means of a joint, the two elements 4, 5 of the piston along the articulation line D. In this case, it is also necessary to provide, in the drive means for rotation about the axis L of the machine, of the control axle whose rotation about its own axis is controlled by the rigid connecting of the two elements 4, 5, a slideway to accommodate the sliding movement of the control axle, in a plane defined by this control axle and the axis of the hinge. It is easier, in this case, to provide a fluidtight connection of the two elements 4, 5 with each other.

Figure 10:
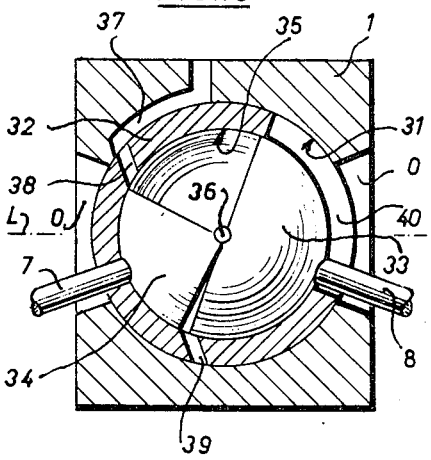
FIGS. 10 and 11 show another embodiment of piston.
Figure 11:
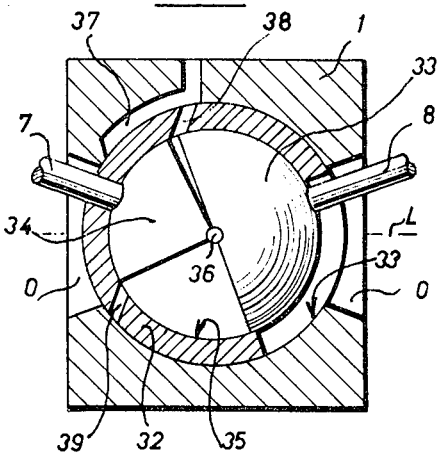

FIGS. 10 and 11 show a modification of the machine in which the construction 1 defines a spherical cavity 31 in the interior of which are disposed the casing 32 and the elements 33, 34 of the piston.

This casing 32 has a spherical external surface sliding within the cavity 31 of the construction 1. This casing 32 is also fixed to the element 34 of the piston. This element 34 has a generally quarter-spherical shape, while the other element of the piston 33, slidably disposed in the spherical chamber 35 of the casing 32, has a generally semi-spherical shape.

The two elements 33 and 34 of the piston are mechanically connected by an axle 36 forming a rigid linkage. There is thus provided an arrangement in which only one of the control axles 7, 8, for example, axle 8, is actuated by a means for rotating it about its own axis; the rotative drive means of the other control axle 7 about axis L of the machine comprising a slideway enabling variations of alignment of this control axle.

The control axle 8 moves, relative to the casing 32, within a slot 40 provided in this casing.

The construction 1 comprises inlet and/or outlet ports 37 of the casing 32 comprising passages 38, 39 opening on the portions of the free space of the piston.

The ports 37 are spaced about the longitudinal axis of the machine in a zone swept by the free space of the piston during movement of the latter. Thus according to the rotation of the piston 33, 34 about the axis L of the machine, the passages 38, 39 of the casing 32 communicate with the various ports 37. There is thus easily obtained an operation of the machine as compressor, pump or hydraulic motor. FIGS. 10 and 11 show each of these extreme positions taken by the piston in the course of its operative cycle. It should be noted that the openings 0 of the construction 1 are circular to permit movement of the control axles 7, 8 about the axis L of the machine.

Figure 12:
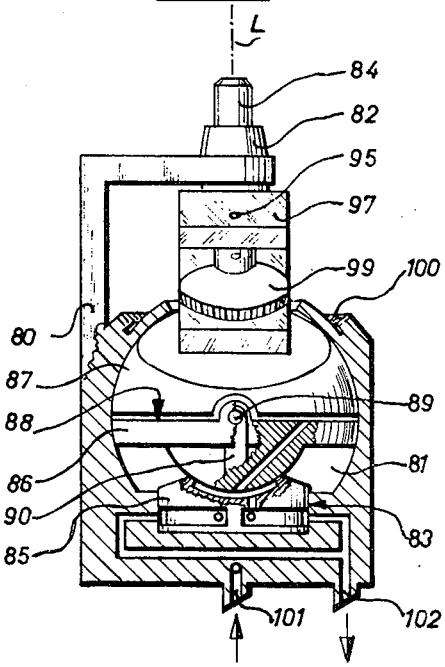
FIG. 12 is a view of a simplified embodiment, the piston being in one of its end positions.
Figure 13:
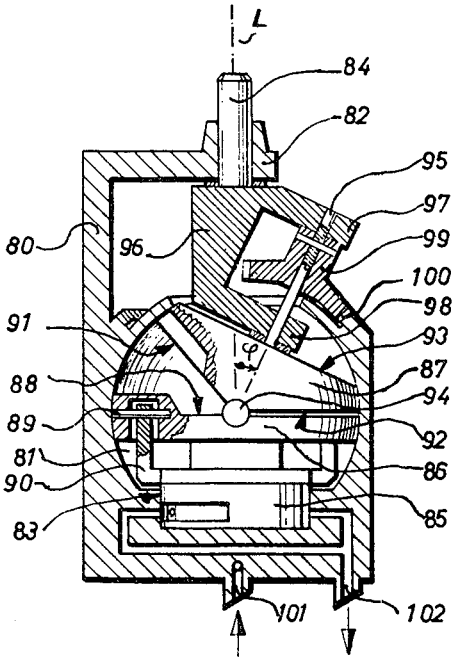
FIG. 13 is a view similar to FIG. 12, the piston being in its other end position.

The simplified embodiment shown in FIGS. 12 and 13 comprises a construction 80, constituting also a fixed casing enclosing a spherical chamber 81. This casing 80 is of generally cylindrical shape and comprises bearings 82, 83 aligned on the longitudinal axis of the casing 80, to rotatably mount the main shaft 84 and the secondary shaft 85 respectively.

In this embodiment, the spherical piston comprises two elements 86, 87 of which 86 has a generally disc shape. This disc 86 has a flat face 88 whose dimensions correspond to those of the equatorial plane of the chamber 81. Disc 86 is a section of a sphere and slides in operation against the spherical wall of the chamber 81.

Disc 86 is pivoted about a control axle 89 passing through the center of the spherical chamber 81 on a yoke 90 which is integral with or fixedly secured to the secondary shaft 85 pivoted on the bearing of the casing 80. Yoke 90 and this secondary shft constitute the rotative drive means of the disc about the longitudinal axis of the machine. The second element 87 of the spherical piston is comprised by a spherical section bounded by three flat faces 91, 92 and 93. the two flat faces 91 and 92, which coact with the equatorial face 88 of the disc, are bounded by diameters of the sphere, and thus of the chamber 81. The third flat face 93 is disposed parallel to the diameter on which the faces 91 and 92 intersects and symmetrically relative to the faces 91, 92. In this way, the center of this third face 93 is located on a diameter of the sphere of the piston or of the chamber 81, perpendicular to that forming the intersection of the faces 91 and 92. The surface of this element comprises a spherical surface whose size corresponds to that of the chamber. The two elements 86, 87 are connected on the diameter comprising the edge of element 87 by an axle 94 constituting the pivotal connection of the elements 86 and 87 to each other and ensuring that the diameter of the disc 86, perpendicular to the diameter on which the yoke 90 is pivoted, will be continuously aligned with the edge formed by the intersection of the two faces 91 and 92 of the other element 87 of the piston. This axle constitutes at the same time the rotative drive means of the axle 89 about its own axis, and thus of the disc 86.

The spherical piston thus constituted moves freely slidably in the interior of the chamber 81.

The element 87 of the spherical piston comprises a control axle 95 integral or rigidly connected to the element 87. This control axle 95 extends perpendicular to the third face 93 of this element and its axis passes through the center of the chamber 81 and thus intersects the center of the edge of the element 87.

The machine comprises also means for rotatably driving this control axle 95 about the longitudinal axis L of the machine. This drive means comprises the main shaft 84 pivoted in the bearing 82 of the casing and whose end within the casing 80 carries a support 96. This support 96 has two bearings 97 and 98 that receive the control axle 95 of the element 87 of the piston. The axis on which the two bearings 97 and 98 of the support 96 are aligned forms an angle $\psi$ with the longitudinal axis L of the machine and passes through the center of the spherical chamber 81. Thus, when the main shaft 84 is rotatably driven, the control axle 95 describes a cone whose apex coincides with the center of the spherical chamber 81 and whose summit angle is equal to $2\psi$.

Finally, this device comprises also means for rotatably driving the control axle 95 about its own axis. This means comprises a pinion 99 mounted rigidly on the control axle 95 between the two bearings 97 and 98 of the support 96. Pinion 99 has conical teeth and meshes with a ring gear 100, also with conical teeth, fixed to the casing 81. The ratio between this pinion 99 and this ring gear 100 is equal to two; and as the ring gear is internally toothed, the control axle 95 turns in the opposite direction from the primary shaft.

Thanks to the ratio of two between the number of turns of the primary shaft 84 and the control axle 95, this control axle turns twice as fast as the primary shaft. The operation of this machine being of the type described with reference to FIGS. 1 to 5 in which the spherical piston effectuates two complete cycles per turn of the primary shaft, namely in which $\alpha = 90°$.

On the other hand, in this embodiment, the connection between the main shaft 84 and the secondary shaft 85 is effectuated by means of the axle 94 which rotatably interconnects the elements 86 and 87 of the piston. These main and secondary shafts 84 and 85 turn with the same speed but in opposite directions. On the other hand, the rotation of the elements of the piston about their own axes is in the same direction.

It should also be noted that the machine is reversible; the piston may be driven through its cycle equally well by the main shaft or the secondary shaft. Moreover, the main and secondary shafts may be rotatably driven in opposite directions by separating the flat face of the disc 86 from the face 91 or 92 of the element 87 of the piston.

It will thus be seen that if there is connected to this machine a suitable distribution system comprising inlet and outlet ports, as well as corresponding conduits 101, 102, it can operate either as a hydraulic or pneumatic motor or as a hydraulic pump or fluid compressor.

As has been seen above, it is of course possible to modify this embodiment so that the piston will undergo a number of different cycles per turn of the main shaft; to this end, the ratio of the number of turns between the main shaft and the control axle may be modified.

Figure 14:
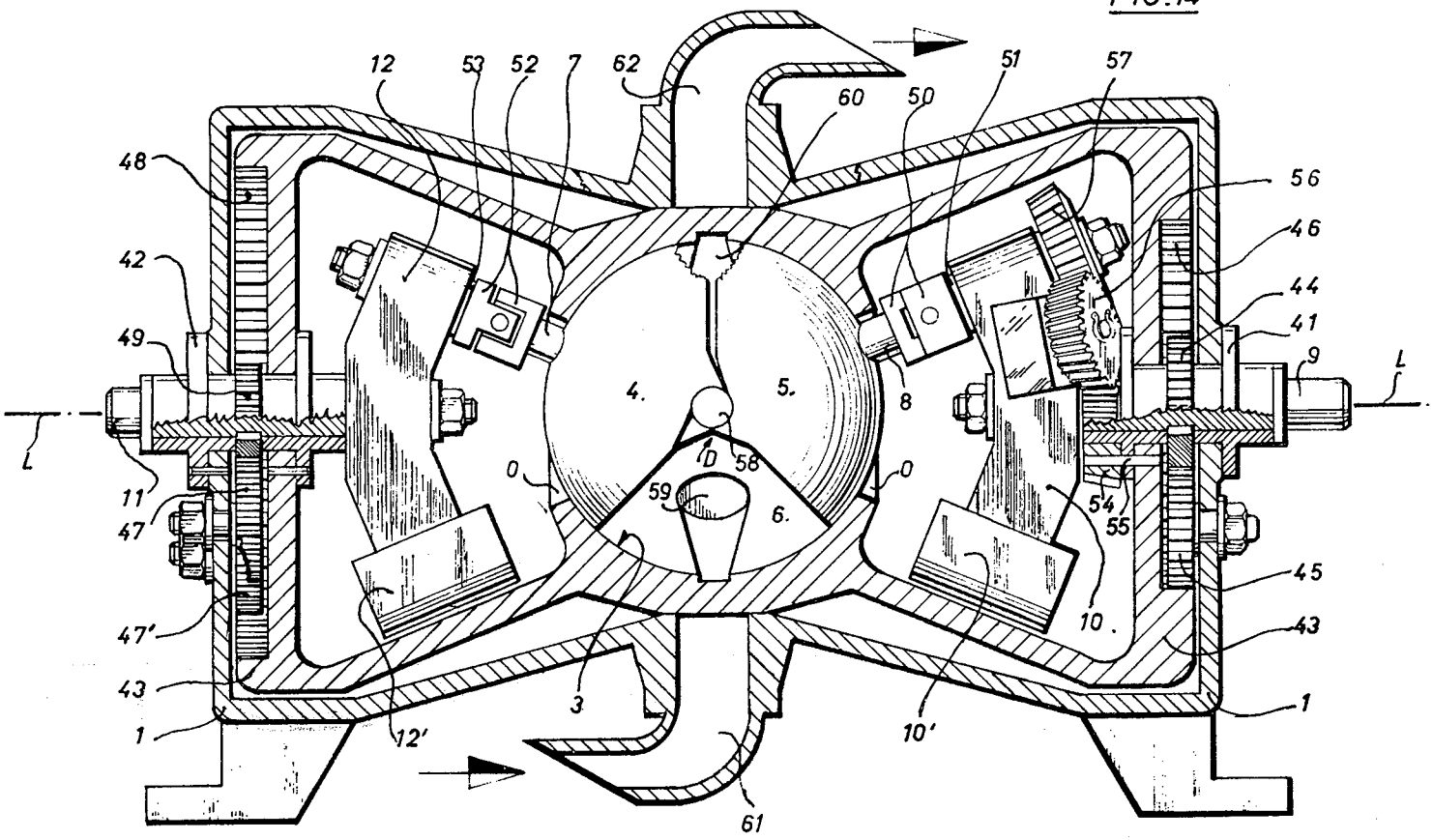
FIG. 14 shows a constructional embodiment of the machine.

FIG. 14 shows a constructional embodiment of the machine. This embodiment comprises a new form of execution of the machine, the inner housing or casing being rotatably driven relative to the outer housing or frame. Because of this, this embodiment is a hybrid corresponding to the case in which $\alpha = 45°$ with respect to the outer housing but $\alpha = 0°$ with respect to the inner housing.

Moreover, as will be seen below, the two elements of the piston are directly mechanically interconnected with each other by a fluidtight driving joint. Because of this, only one of the control axles compriss a driving means for rotation about its own axis, the rotatable driving means about the axis L of the machine of the other control axle comprising a slideway accommodating the variations in alignment of this control axle that arise in the course of operation.

Referring to FIG. 14, the machine comprises an outer casing or frame 1 provided with bearings 41, 42 aligned on the longitudinal axis L of the machine, in which are pivoted respectively the main shaft 9 and the secondary shaft 11.

The illustrated machine comprises an inner casing 43 that is rotatable and is pivotally mounted on the main shaft 9 and the secondary shaft 11. This inner casing 43 comprises a spherical chamber 3 provided with circular openings 0 through which the control axles 7, 8 pass. These control axles 7, 8 are fixed at least angularly each to an element 4, 5 of the spherical piston disposed in the interior of the chamber 3 and defining the free space 6.

The main shaft 9 rotatably drives a pinion 44 which meshes with an intermediate pinion 45 pivoted on the casing 1, which meshes in turn with an internally toothed crown 46 fast with the casing 43. The ratio of this transmission is 1:3, such that the casing 43 turns three times more slowly than the main shaft and in the opposite direction.

On the other hand, the casing 43 is mechanically connected to the secondary shaft 11 by two intermediate pinions 47 47′ that mesh with each other and engage respectively with an internally toothed crown 48 of the casing 43 and a pinion 49 fixed to the secondary shaft 11. The ratio of this transmission is 5, the secondary shaft 11 turning faster than the casing 43 and in the same direction. Each control axle 7, 8 has means for drivingly rotating it about the axis L of the machine.

The control axle 8 is mechanically connected by means of a coupling 50, of the cardan type, to an axle 51 pivoted on the support 10 fixed to the main shaft 9. In this way, the coupling 50 permits absorbing minor angular variations between the axles 8 and 51 in two orthogonal directions relative to each other as well as minor axial displacements of the axle 8 with respect to the axle 51.

The rotatable drive means of the control axle 7, about the axis L of the machine, comprises a support 12 fixed to the secondary shaft 11 and a sliding connection 52, connecting the control axle 7 to an axle 53 rotating in the support 12. This sliding coupling 52 presents the same characteristics as the coupling 50 and further permits the control axle 7 to move parallel to the articulation line D of the elements 4, 5 of the piston, relative to the axle 53 pivoted in the support 12. The two supports 10 and 12 each comprise a balanced mass 10′, 12′ substantially diametrically opposed to the couplings 50 and 52, respectively.

The machine also comprises rotatable drive means for the control axle 8 about its own axis, comprising three pinions. A first pinion 54 is fixed to the casing 43 by means of a pin 55. An intermediate pinion 56 pivoted on an axis carried by the support 10, extends in the direction of the center of the spherical chamber 3. This axis is displaced relative to a plane passing through the axis L of the machine and the axle 51 pivoted in the support 10. This intermediate pinion 56 meshes both with the pinion 54 and with a pinion 57 fixed to the axle 51 connected by the coupling 50 to the control axle 8. The ratio of this transmission is equal to one. The control axle 8 turns about its own axis at the same speed as the casing 43 about the axis L of the machine and in the same direction.

The control axle 7 has no means for driving it in rotation about its own axis. Thus the two elements 4, 5 of the piston are directly connected to each other by a joint comprising an axle 58.

The casing 43 has passages 59, 60 so disposed as to open into the space 6. This is possible because the piston does not turn relative to the casing 43. These passages 59, 60 cooperate with a series of inlet and outlet ports 61, 62 disposed in the casing 1. These ports 61, 62 are spaced along the sliding surface which is disposed between the casing 43 and the casing 1 and are successively placed in communication with passages 59, 60 by the rotation of the inner casing relative to the outer casing.

The machine illustrated in FIG. 14 can function as a four cycle internal combustion engine if there is provided in the casing 1, inlet and outlet ports which connect according to a predetermined cycle the passages 59, 60 and the ports 61, 62 as well as the passages 59, 60 with ignition means.

FIGS. 15–19 illustrate schematically the manner in which the ports may be arranged to obtain a four cycle internal combustion engine, utilizing the space 6 as the compression and explosion chamber.

FIGS. 15–19 are schematic cross sections of the machine shown in FIG. 14, functioning as a four cycle internal combustion engine. The schematic cross sections permit following the course of the four cycles.

It must be remembered that the machine described in connection with FIG. 14 comprises a casing 43 turning relative to a casing 1 and that the piston 4, 5 turns with the same speed as the casing 43. This piston therefore behaves relative to casing 1 like that of a machine in which $\alpha = 45°$; while this piston also behaves relative to the casing 43 like that of a machine in which $\alpha = 0°$. The relative movement between the piston 4, 5 and the casing 43 comprises an angular oscillation of the articulation line of the two elements 4, 5 of the piston, about the center of the spherical chamber of the casing 43, in a plane parallel to the longitudinal axis L of the machine, that is to say, perpendicular to the plane of the illustrated sections. In such a machine, the piston effects two complete cycles per complete revolution of the piston relative to the casing 1.

To embody an internal combustion engine with such a machine, inlet ports 63 and 64 and outlet ports 65, 66 pass through casing 1 and open on the sliding surface located between the casings 1 and 43. The ports 63–66 may be connected to suitable conduits.

The inlet ports 63, 64 are aligned on a diameter of the spherical chamber of the casing 43.

The outlet ports 65, 66 are also aligned on a diameter of the spherical chamber of casing 43, this diameter forming an angle of 45° relative to the diameter on which the inlet ports 63, 64 are aligned.

The casing 43 comprises ports 67 and 68 opening, on the one hand on the sliding face of casing 43 in the casing 1, and being therefore placed in communication with the ports 63–66, and on the other hand in the spherical chamber of the casing 43 where the piston is located.

The external ends of these ports 67, 68 are of the same size as the ports 63–66 and are displaced by 45° with respect to each other, so that when the port 67 is in registry with the inlet port 63, the port 68 will be in registry with the outlet port 66.

These ports diverge in the direction of the spherical chamber and terminate approximately tangentially, on at least one side, in this chamber.

It should be noted that the part 69 of the casing 43, located between two ports 67 and 68, is fairly large so as to ensure fluidtightness, the more because the piston does not rotate about the axis L of the machine relative to the casing 43.

Spark plugs 70, 71 are mounted in the casing 1 and their electrodes are located in a spaces 72, 73 provided in the casing 1, and terminate near the sliding surface between the casing 1 and the casing 43. These spark plugs are located on a diameter of the spherical chamber which is symmetric with respect to the inlet and outlet ports 63–66.

The piston, which in the cross section is shown only as element 5, situated in front of the other element, is disposed in the spherical chamber of the casing 43 and is driven by the control axle 7, 8 as described in connection with FIG. 14.

Figure 15:
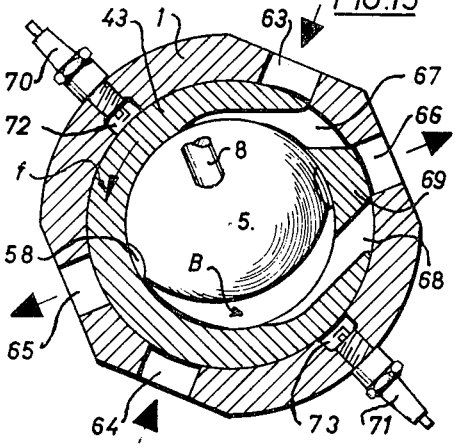
FIGS. 15–19 are diagrams illustrating a distribution system for the machine shown in FIG. 14 operating as a four-cycle internal combustion engine.

FIG. 15 shows the machine in the position it occupies when the space A of the piston, corresponding to the port 67, is at the beginning of intake and in which accordingly the space B of the piston, corresponding to the port 68, is at the beginning of exhaust. In this position, the volume of the space A is at a minimum while the volume of the space B is at a maximum.

Figure 16:
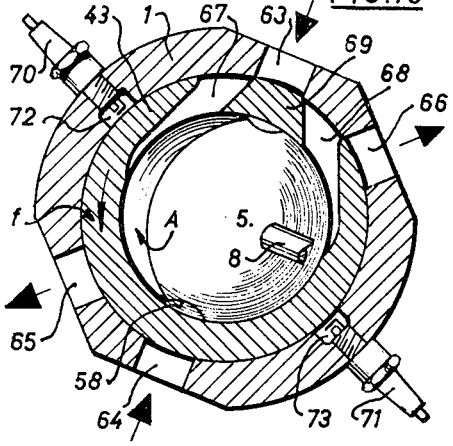

To the extent that the casing 43 turns relative to the casing 1, in the direction of the arrow *f*, the ports 67 and 68 communicate with the inlet port 63 and the outlet port 66, respectively, and, as during this time the piston moves relative to the casing in a manner so as to increase the volume of the space A, the position illustrated in FIG. 16 is reached in which the space A is at its maximum volume while the space B is at its minimum volume. During this rotation of ⅛th of a turn of the casing 43 relative to the casing 1, the space A has been continuously in communication by the port 67 with the inlet port 63 and it is thus full of a carburized mixture. During this time, the space B was connected by the port 68 to the outlet port 66 so that the combustion gases remaining in this space have been evacuated by the decrease in size of cavity B.

Figure 17:
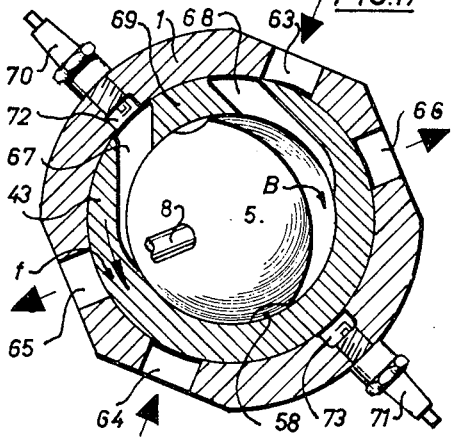
Figure 18:
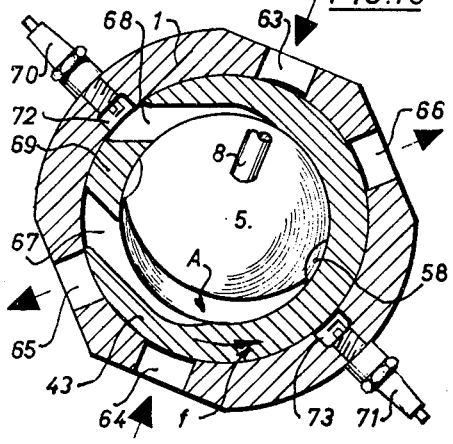

If the rotation of the casing 43 relative to casing 1 continues, after ⅛th turn the position is reached that is illustrated in FIG. 17. In this position, the space B has achieved its maximum volume while the port 68 was in communication with the inlet port 63. This space B is thus filled with a carburized mixture. During this time, the space A decreased in volume to its minimum volume while the port 67 is in communication with the space 72 in which the electrodes of the spark plugs 70 are located. At this moment, the combustible gas disposed in the space A of the piston is compressed and its ignition is effected by a spark from spark plug 70.

This explosion separates the walls of the space A of the piston which causes, by the mechanical connections described in reference to FIG. 14, the rotation of the main shaft 9 and the secondary shaft 11 in opposite directions, and the rotation of the casing 43 relative to the casing 1. Under the influence of this explosion the volume of the space A increases to its maximum while that of the space B decreases to its minimum. At this point, shown in FIG. 18, the space B, whose carburized mixture has been compressed, is in communication by port 60 with the space 72. On the other hand, the space A is entirely open and will be placed in communication with the outlet port 65 by the port 67.

Figure 19:
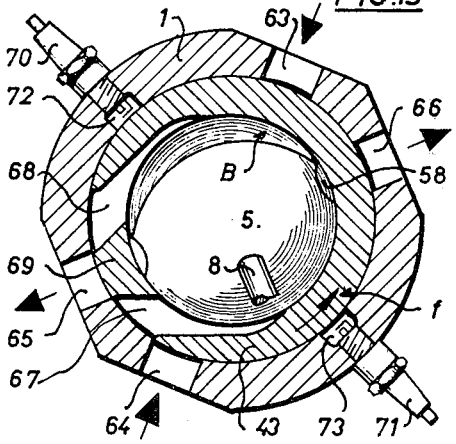

A spark plug causes the explosion in space B, which causes the opening of the latter and the closing of the space A, whose contents escape by the port 65, until space B is fully open and space A closed, which position is shown in FIG. 19. Space A is thus evacuated and ready to be refilled, this time by the port 64. The piston has undergone a complete cycle for a rotation of 180° of the casing 43 relative to the casing 1. A new cycle can begin, identical to that described but displaced by 180°, the explosions being effectuated by the spark plug 71.

This four cycle internal combustion engine produces four explosions per revolution of the casing 43.

It should also be noted that the main shaft and secondary shaft turn respectively three and five times as fast as the inner casing. It is thus possible to provide for a large number of turns of the motor shafts without also causing rapid rotation of the portions of the motor with high inertia.

Another advantage of the described motor proceeds from the fact that the high pressures due to explosion are absorbed by the large spherical surfaces of the piston, which reduces their force and their wear, the more so because the mechanical connection between the elements 4, 5 of the piston is arranged in such a way as to permit slight play of these elements perpendicular to the axis of the joint. In this case the two elements 4, 5 of the piston will be constantly in contact with the spherical wall of the chamber.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A spherical piston machine comprising a chamber whose wall is at least partly spherical; a spherical piston, mounted within this chamber, comprising two elements; this chamber and this piston delimiting a free space of variable shape; each of the elements of the piston being angularly fixed to a control axle, forming an angle with the longitudinal axis of the machine and extending in a direction passing through the center of the spherical chamber; the two elements of the spherical piston being articulated in a zone extending perpendicular to each control axle; means for rotatably driving about its own axis each of the control axles; the elements of the piston being independent from each other; and means for rotatably driving each control axle in opposite directions and at different speeds of rotation about the longitudinal axis of the machine whereby said zone rotates about said longitudinal axis of the machine.

2. A machine as claimed in claim 1 in which the means for drivably rotating a control axle about its own axis, comprises three pinions: a first pinion fixed to the casing, concentric with the axis of the machine; a second pinion fixed to the control axle; and a third pinion meshing with the other two pinions whose axis is outside the plane containing the two other pinion axes but passes also through the center of the spherical chamber.

3. A machine as claimed in claim 1 in which in operation, the line of articulation of the two elements of the piston undergoes a sinusoidal movement relative to a great circle of the chamber of the casing.

4. A machine as claimed in claim 1 in which the total free volume within said chamber is constant.

5. A machine as claimed in claim 1 in which the piston undergoes a number of complete cycles per complete revolution about the axis of the machine.

6. A machine as claimed in claim 1 and a casing enclosing said chamber, said spherical piston elements having at least in part the spherical shape of the chamber; said elements being slidably mounted within said chamber.

7. A machine as claimed in claim 6, in which one of the elements of the spherical piston has a flat surface disposed in an equatorial plane of the spherical chamber.

8. A machine as claimed in claim 6 the casing being fixed.

9. A machine as claimed in claim 1, in which in the mid position of the cycle of movement of the piston, the control axles of this piston are in alignment.

10. A machine as claimed in claim 9 in which in one of the extreme positions of the cycle of movement of the piston, the control axles of the piston form an angle between themselves and that in the other extreme position of the cycle the axles form between themselves an identical but opposite angle.

11. A machine as claimed in claim 9 in which the control axles of the piston form identical angles with the longitudinal axis of the machine.

12. A machine as claimed in claim 11 in which each spherical piston element is in the form of a part sphere having two flat faces disposed generally radially of the chamber at an angle to each other which is at least equal to four times the angle comprised by each control axle with the longitudinal axis of the machine.

13. A machine as claimed in claim 1 and a mechanical connection between the two rotatable drive means of the control axles, which rotate these axles in opposite directions about the longitudinal axis of the machine.

14. A machine as claimed in claim 13 in which this mechanical connection imposes a ratio between 1 and 3 between the numbers of turns of the control axles about the longitudinal axis of the machine, these axles turning in opposite directions.

15. A machine as claimed in claim 1 in which the two control axles of the piston define a plane perpendicular to the zone of articulation no matter what the position of the machine.

16. A machine as claimed in claim 15 in which the angular movement of the two control axles about the zone of articulation occurs at the same instantaneous speed.

17. A spherical piston machine comprising a chamber whose wall is at least partly spherical; a spherical piston, mounted within this chamber, comprising two elements; this chamber and this piston delimiting a free space of variable shape; each of the elements of the piston having a control axle, forming an angle with the longitudinal axis of the machine and extending in a direction passing through the center of the spherical chamber at least one of the elements of the piston being angularly fixed to its associated said control axle; the two elements of the spherical piston being articulated in a zone extending perpendicular to each control axle; a joint that interconnects said piston elements along said zone of articulation, means for rotatably driving about its own axis at least one of the control axles; at least one of said control axles being in two parts, a sliding connection between said two parts permitting movement of said parts relative to each other in a direction perpendicular to the axes of said parts; and means for rotatably driving each control axle in opposite directions and at different speeds of rotation about the longitudinal axis of the machine whereby said zone rotates about said longitudinal axis of the machine.

18. A machine as claimed in claim 17 in which at least one of the means for rotatably driving a control axle about the longitudinal axis of the machine comprises a sliding connection permitting pivoting of this control axle about the center of the spherical chamber parallel to the line of articulation of the piston elements.

19. A machine as claimed in claim 17 in which the means for drivably rotating a control axle about its own axis, comprises three pinions: a first pinion fixed to the casing, concentric with the axis of the machine; a second pinion fixed to the control axle; and a third pinion meshing with the other two pinions whose axis is outside the plane containing the two other pinion axes but passes also through the center of the spherical chamber.

20. A machine as claimed in claim 17 in which in operation, the articulation line of the two elements of the spherical piston undergoes a substantially linear reciprocatory movement relative to the casing.

21. A machine as claimed in claim 17 in which only one of the control axles has means for rotating it about its own axis; the means for driving the other control axle about the longitudinal axis of the machine comprising a sliding coupling.

22. A machine as claimed in claim 17 in which the total free volume within said chamber is constant.

23. A machine as claimed in claim 17 in which the piston undergoes a number of complete cycles per complete revolution about the axis of the machine.

24. A machine as claimed in claim 17 and a casing enclosing said chamber said spherical piston elements having at least in part the spherical shape of the chamber; said elements being slidably mounted within said chamber.

25. A machine as claimed in claim 24 in which one of the elements of the spherical piston has a flat surface disposed in an equatorial plane of the spherical chamber.

26. A machine as claimed in claim 24 in which the casing is rotatably mounted in a frame, and rotatable drive means for the casing with respect to the frame, the piston being driven by its control axles in relative movements with respect to the casing and to the frame.

27. A machine as claimed in claim 26 in which the ratio between the number of turns about the longitudinal axis of the machine, of the control axles, is equal to −3; −2; 5/3; 5/3.

28. A machine as claimed in claim 26 in which the ratio between the number of rotations of the control axles about their own axis and about the longitudinal axis of the machine are respectively equal to −2 and −⅔; −3/2 and −¾; or −4/3 and −4/5.

29. A machine as claimed in claim 26 in which the rotatable drive means for the casing relative to the frame comprises a gear train connecting the shaft of each rotatable drive means of the control axles about the longitudinal axis of the machine, to the casing.

30. A machine as claimed in claim 29 in which one of the gear trains comprises an even number of gears while the other comprises an odd number of gears, the shafts of the rotatable drive means of the control axles about the longitudinal axis of the machine turning in opposite directions.

31. A machine as claimed in claim 30 in which each gear train comprises a pinion fixed to the shaft of the rotatable drive means of a control axle about the axis of the machine, and an internally toothed gear ring fixed to the casing.

32. A machine as claimed in claim 30 in which the multiplication ratio of one of the gear trains is between one and three times the multiplication ratio of the other gear train.

33. A machine as claimed in claim 17 in which in the mid position of the cycle of movement of the piston, the control axles of this piston are in alignment.

34. A machine as claimed in claim 33 in which in one of the extreme positions of the cycle of movement of the piston, the control axles of the piston form an angle between themselves and that in the other extreme position of the cycle the axles form between themselves an identical but opposite angle.

35. A machine as claimed in claim 33 in which the control axles of the piston form identical angles with the longitudinal axis of the machine.

36. A machine as claimed in claim 35 in which each spherical piston element is in the form of a part sphere having two flat faces disposed generally radially of the chamber at an angle to each other which is at least equal to four times the angle comprised by each control axle with the longitudinal axis of the machine.

37. A machine as claimed in claim 17 and means for rotatably driving each control axle about its own axis of rotation.

38. A machine as claimed in claim 37 and a mechanical connection between the two rotatable drive means of the control axles, which rotate these axles in opposite directions about the longitudinal axis of the machine.

39. A machine as claimed in claim 16 in which this mechanical connection imposes a ratio between 1 and 3 between the numbers of turns of the control axles about the longitudinal axis of the machine, these axles turning in opposite directions.

40. A machine as claimed in claim 17 in which the two control axles of the piston define a plane perpendicular to the zone of articulation no matter what the position of the machine.

41. A machine as claimed in claim 40 in which the angular movement of the two control axles about the zone of articulation occurs at the same instantaneous speed.

42. A machine as claimed in claim 17 having inlet and outlet ports spaced angularly an amount equal to the angular displacement effectuated by the piston for a half cycle of the same.

43. A machine as claimed in claim 42 in which the ports open tangentially into the spherical chamber.

44. A machine as claimed in claim 1, there being means for rotatably driving about its own axis only one of said control axles, said joint driving the said element that is associated with the other said control axle.

45. A machine as claimed in claim 44 in which the line of articulation of the elements of the piston undergoes relative rotation in an opposite direction relative to each of the rotatable drive means of the control axles about the axis of the machine, and that the direction of rotation of one of these drive means of a control axle about the axis of the machine is in the opposite direction of rotation of the other of these drive means.

* * * * *